US005584587A

United States Patent [19]

Koike et al.

[11] Patent Number: 5,584,587

[45] Date of Patent: Dec. 17, 1996

[54] RIBBON CASSETTE AND VIDEO PRINTER FOR USE THEREWITH

[75] Inventors: Takashi Koike, Katano; Takayuki Kawamura, Kadoma; Tetsuya Hokamura, Osaka; Kazuhiro Nishikawa, Ibaraki; Tsuneharu Nishikura, Ikoma, all of Japan

[73] Assignee: Matsushita Electric Industrial Co., Ltd., Osaka-fu, Japan

[21] Appl. No.: 521,971

[22] Filed: Aug. 31, 1995

[30] Foreign Application Priority Data

| | | | |
|---|---|---|---|
| Sep. 1, 1994 | [JP] | Japan | 6-208412 |
| Sep. 1, 1994 | [JP] | Japan | 6-208413 |
| Oct. 7, 1994 | [JP] | Japan | 6-243795 |

[51] Int. Cl.[6] ..... B41J 35/28

[52] U.S. Cl. ..... 400/246; 400/120.01; 400/207

[58] Field of Search ..... 400/207, 208, 400/208.1, 242, 246, 120.01, 120.02, 224.2

[56] References Cited

U.S. PATENT DOCUMENTS

| | | | |
|---|---|---|---|
| 4,892,425 | 1/1990 | Shimizu et al. | 400/246 |
| 4,978,240 | 12/1990 | Katsuno | 400/246 |
| 5,352,049 | 10/1994 | Shiraishi et al. | 400/246 |

FOREIGN PATENT DOCUMENTS

| | | | |
|---|---|---|---|
| 0072775 | 4/1985 | Japan | 400/246 |

*Primary Examiner*—John S. Hilten
*Attorney, Agent, or Firm*—Ratner & Prestia

[57] ABSTRACT

A ribbon cassette for accommodating a length of inked ribbon for use with a thermal wax transfer printer. The cassette includes a generally cylindrical supply casing having a supply slot defined therein so as to extend parallel to a first longitudinal of the supply casing and rotatably accommodating therein a supply spool, a generally cylindrical take-up casing having a take-up slot defined therein so as to extend parallel to a second longitudinal axis of the take-up casing and also to the supply slot and rotatably accommodating therein a take-up spool, a length of inked ribbon having opposite ends engaged with the supply and take-up spools within the supply and take-up casings, respectively. The supply and take-up casings are connected together so as to extend parallel to each other by means of an elongated front plate secured at its opposite end portions to respective front open ends of the supply and take-up casings, and a slender bridge having opposite ends secured to respective rear ends of the supply and take-up casings. The take-up slot is located at a level generally aligned with a plane, containing the first and second longitudinal axes, and opening laterally outwardly so as to confront the supply casing. The supply and take-up slots is so positioned relative to each other as to permit a portion of the length of inked ribbon extending between the supply and take-up slots to extend diagonally upwardly from the supply slot towards the take-up slot.

11 Claims, 6 Drawing Sheets

RIBBON CASSETTE AND VIDEO PRINTER FOR USE THEREWITH

BACKGROUND OF THE INVENTION

1. Field of the Invention

The present invention generally relates to a cassette for accommodating a length of inked ribbon for use with a thermal wax transfer printer and also to a printer mechanism operable with the ink ribbon cassette.

2. Description of the Prior Art

Printers capable of printing video signals on recording media in full color are now widespread. Although the present invention is applicable in general to a thermal wax transfer printer, in discussing the prior art pertinent to the present invention reference will be made to a so-called "video printer" capable of making a full-color print of a picture captured from a television receiver set or a video camera.

The conventional video printer generally comprises a sheet supply unit adapted to accommodate a stack of recording sheets; a thermal print head supported for movement between print and retracted positions at a printing station; a platen disposed at the printing station and cooperable with the thermal print head, when the latter is moved to the print position, to allow an ink material to be transferred from the length of inked ribbon onto one of the recording sheets then fed to the printing station; a first guide mechanism extending between the sheet supply unit and the printing station; a second guide mechanism extending from the printing station to a temporary storage position defined on one side of the printing station remote from the first guide mechanism; and a reversible feed means for feeding the recording sheets one at a time towards the temporary storage position along the first guide mechanism and then along the second guide mechanism and also for feeding the recording sheet backwards from the temporary storage position towards a sheet recovery position past the printing position once the recording sheet has been fed to the temporary storage position.

The prior art ribbon cassette accommodating therein a reeled length of inked ribbon for use in the video printer will be discussed with reference to FIGS. 14 and 15. As shown therein, the ribbon cassette generally identified by 8 comprises substantially cylindrical take-up and supply casings 2 and 4 spaced a part from each other so as to extend parallel to each other. The cylindrical take-up and supply casings 2 and 4 are connected together by means of a generally elongated front end plate having its opposite end portions thereof closing respective front open ends of the cylindrical casings 2 and 4, and a slender bridge 6 having its opposite ends rigidly connected with, or otherwise integrally formed with respective rear ends of the cylindrical casings 2 and 4. The take-up and supply casings 2 and 4 have take-up and supply spools 32 and 34 each rotatably accommodated within the corresponding casing and also have respective slots 2*a* and 4*a* defined therein so as to extend parallel to the longitudinal axis of the corresponding casings 2 and 4.

As clearly shown therein, the take-up and supply slots 2*a* and 4*a* in the take-up and supply casings 2 and 4, respectively, are located at the same level beneath the plane containing the respective longitudinal axes of the take-up and supply casings 2 and 4 (or those of the take-up and supply spools 32 and 34), and opens laterally outwardly so as to confront with each other. The slender bridge 6 have its opposite ends positioned adjacent the take-up and supply slots 2*a* and 4*a* and extend parallel to and beneath that plane containing the respective longitudinal axes of the take-up and supply casings 2 and 4. Hence, that portion of the reeled length of inked ribbon 26 between the supply and take-up slots 4*a* and 2*a* extends parallel to and below that plane.

As shown in FIG. 15, let it be assumed that the thermal print head 40, the platen 42 and the pinch and capstan rollers 46 and 44 occupy respective predetermined positions inside the video printer as shown therein. When the prior art ribbon cassette 8 of the above described construction is inserted into the video printer, the thermal print head 40 in the retracted position assumes a position above the slender bridge 6 and both of the pinch and capstan roller pair 46 and 44) and the platen 40 assumes respective positions below the slender bridge 6. Even though the prior art video printer in combination with the prior art ribbon cassette works satisfactorily, the prior art video printer is of a size having a relatively great height or thickness above a support surface on which it is placed since both of the pinch and capstan roller pair and the platen 42 must necessarily be disposed below the bottom plane of the slender bridge 6. If they are not so disposed, the ribbon cassette being inserted into the video printer will collide against the platen 42 and at least the pinch roller 46 and will be unable to reach a completely inserted position.

Thus, the prior art video printer requires a relatively large space for accommodating the thermal print head 40 in the retracted position and, also, at least the pinch roller 46 and the platen 42, in order for the prior art ribbon cassette 8 to be smoothly inserted into the video printer to reach the completely inserted position. This brings about an increase in thickness or height of the video printer as a whole.

SUMMARY OF THE INVENTION

The present invention has been devised to substantially eliminate the problems inherent in the prior art video printer and also in the prior art ribbon cassette and is intended to provide an improved ribbon cassette effective to contribute to reduction in size of the video printer as a whole.

Another important object of the present invention is to provide an improved video printer operable with the improved ribbon cassette which advantageously accomplish a maximized utilization of space and which is therefore compact in size.

In order to accomplish the foregoing objects, the present invention in one aspect thereof provides a ribbon cassette for accommodating a length of inked ribbon for use with a thermal wax transfer printer. The cassette includes a generally cylindrical supply casing having a supply slot defined therein so as to extend parallel to a first longitudinal of the supply casing and rotatably accommodating therein a supply spool, a generally cylindrical take-up casing having a take-up slot defined therein so as to extend parallel to a second longitudinal axis of the take-up casing and also to the supply slot and rotatably accommodating therein a take-up spool, a length of inked ribbon having Opposite ends engaged with the supply and take-up spools within the supply and take-up casings, respectively. The supply and take-up casings are connected together so as to extend parallel to each other by means of an elongated front plate secured at its opposite end portions to respective front open ends of the supply and take-up casings, and a slender bridge having opposite ends secured to respective rear ends of the supply and take-up casings. The take-up slot is located at a level generally aligned with a plane, containing the first and second longitudinal axes, and opening laterally outwardly so as to confront the supply casing. The supply and take-up slots is so positioned relative to each other as to permit a portion of the length of inked ribbon extending between the supply and take-up slots to extend diagonally upwardly from the supply slot towards the take-up slot.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENTS

Referring first to FIGS. 1 to 4, there is shown a ribbon cassette 10 for accommodating a length of inked ribbon for use in a video printer of a type generally known as a thermal sublimative dye transfer printer. The length of inked ribbon for use in the video printer is known comprising a length of a film base having one surface coated with a thermally fusible pigment layer over the entire length thereof which is black in color throughout the length thereof for printing in black or gray tone or which is a repetition of three colors, cyan, magenta and yellow, over the entire length for printing in full color.

Figure 1:
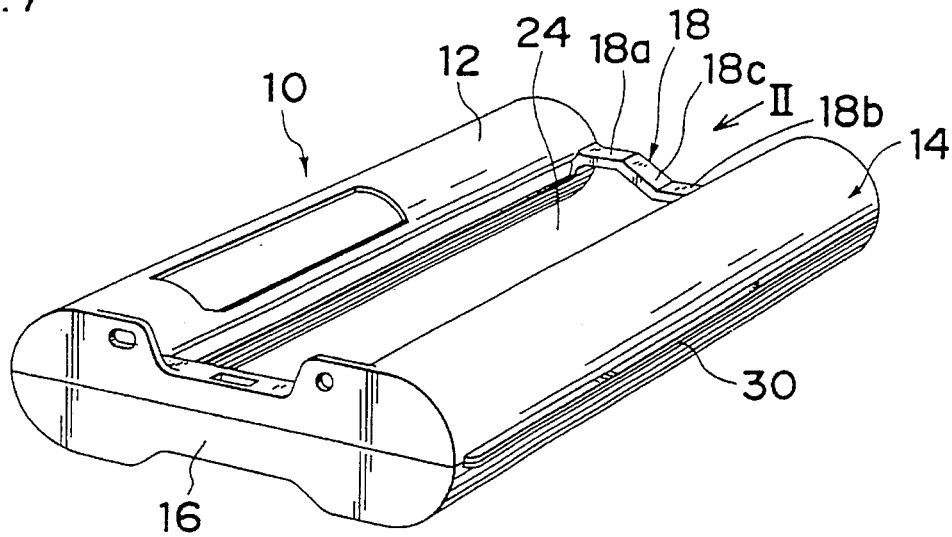
FIG. 1 is a perspective view of a ribbon cassette for accommodating a roll of inked ribbon according to a first preferred embodiment of the present invention.
Figure 2:
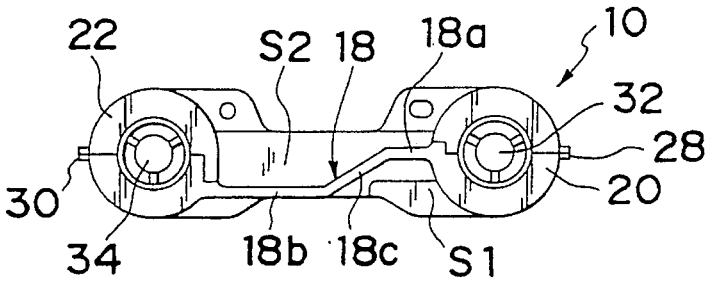
FIG. 2 is a rear end view of the ribbon cassette as viewed in a direction shown by the arrow II in FIG. 1.

The ribbon cassette shown in FIGS. 1 to 4 comprises substantially cylindrical take-up and supply casings 12 and 14 spaced a part from each other so as to extend parallel to each other. The cylindrical take-up and supply casings 12 and 14 are connected together by means of a generally elongated front end plate 16 having its opposite end portions thereof closing respective front open ends of the cylindrical casings 12 and 14 and also having a generally intermediate portion thereof constricted in width, and a slender bridge 18 having its opposite ends rigidly connected with, or otherwise integrally formed with respective rear ends of the cylindrical casings 12 and 14. As best shown in FIG. 2, respective rear open ends of the cylindrical casings 12 and 14 are closed by annular end plates 20 and 22. Thus, it will readily be seen that the ribbon cassette is of a configuration having an oblong space 24 delimited by the cylindrical casings 12 and 14, the front end plate 16 and the slender bridge 18. The terms "front" and "rear" used hereinabove and hereinafter in connection with components of the ribbon cassette are to be understood as being relative to the direction of insertion In (FIG. 3) into the video printer.

Figure 4:
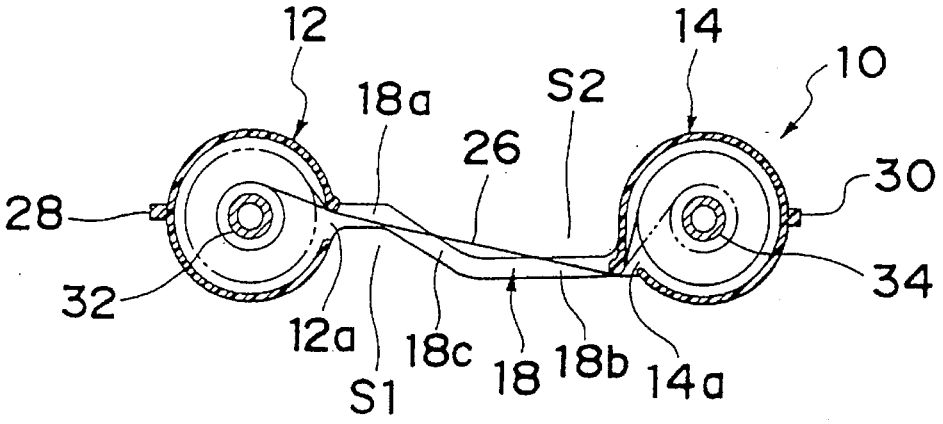
FIG. 4 is a cross-sectional view, on a somewhat enlarged scale, of the ribbon cassette taken along the line IV—IV in FIG. 3.

As best shown in FIG. 4, the cylindrical casings 12 and 14 have ribbon take-up and supply spools 32 and 34 each rotatably accommodated within the corresponding casing. The take-up and supply casings 12 and 14 have respective slots **12*a* and 14*a* defined therein, each of said slots 12*a* and 14*a* extending parallel to the longitudinal axis of the corresponding casing 12 and 14. As clearly shown therein, the slot 12*a* in the take-up casing 12 is located at a level generally aligned with a plane, containing the respective longitudinal axes of the take-up and supply casings 12 and 14 (or those of the take-up and supply spools 32 and 34), and opens laterally outwardly so as to confront the supply casing 14. On the other hand, the slot 14*a* in the supply casing 14 is located a distance below that plane as viewed in FIG. 4 and opens diagonally downwardly on one side of the supply casing 14 adjacent the take-up casing 12 so that a portion of the length of inked ribbon 26 emerging downwardly outwardly through the supply slot 14*a* can travel towards the take-up slot 12*a* in the take-up casing 12** along a generally upwardly oriented path.

Preferably, opposite longitudinal lip regions of the wall of at least the supply casing 14, which confronts the supply slot **14*a*, are rounded so as to avoid the possibility that the length of inked ribbon 26 running so as to emerge outwardly through the supply slot 14*a* may be scratched in sliding contact therewith. Specifically, one of the opposite longitudinal lip regions of the wall of at least the supply casing 14, which faces the coated surface of the length of inked ribbon 26, is so positioned substantially radially inwardly of the other of the opposite longitudinal lip regions thereof that a recording sheet S being moved past a printing station, as will be described later, will not plunge into the supply slot 14*a*, but can be positively guided to divert downwardly without entering the supply slot 14*a***.

The length of inked ribbon generally identified by 26 has a leading end rigidly secured to the tape-up spool 32 through the slot **12*a* in the take-up casing 12 and a trailing end loosely extending into the supply casing 14 and then wound around the supply spool 34, it being to be noted that the terms "leading" and "trailing" hereinabove and hereinafter used are to be understood as used relative to the direction of feed of the length of inked ribbon 26 from the supply spool 34 towards the take-up spool 32. In this arrangement, the slots 12*a* and 14*a* are so defined in the respective take-up and supply casings 12 and 14 and so positioned relative to each other that that portion of the length of inked ribbon 26 emerging downwardly outwardly through the slot 14***a* in the supply casing 14 extends diagonally upwardly towards the slot 12*a* in the take-up casing 12 so as to angularly traverse the plane containing the respective longitudinal axes of the take-up and supply casings 12 and 14.

It is to be noted that during the feed of the length of inked ribbon 26 from the supply spool 34 within the supply casing 14 towards the take-up spool 32 within the take-up casing 12 the coated surface of the inked ribbon 26 where the thermally fusible pigment layer is formed is oriented downwards as viewed in FIG. 4, but depending upon the position of the thermal print head in the video printer the coated surface of the inked ribbon 26 may be oriented upwards.

Referring still to FIGS. 1 to 4, the ribbon cassette 10 has guide wings 28 and 30 formed integrally with the take-up and supply casings 12 and 14, respectively, so as to protrude laterally outwardly therefrom and also so as to extend substantially over the length of the corresponding casings 14 and 12. The guide wings 28 and 30 serve to permit the ribbon cassette 10 to be properly inserted into and positioned at a printing station inside a video printer as will be described later.

It is to be noted that, in a manner similar to any of the existing video tape cassettes or audio tape cassettes, the ribbon cassette 10 is made of plastics and is in practice of a two-piece construction including upper and lower halves which may be separated along, for example, the plane containing the respective longitudinal axes of the supply and take-up casings 12 and 14, but joined together to provide a single cassette integer. A line of separation between the upper and lower cassette halves are clearly shown in FIGS. 1 and 2. However, those skilled in the art can readily conceive the use of three or more components to be assembled together to provide the single ribbon cassettes, depending on particulars of the design of molding dies.

In the embodiment shown in FIGS. 1 to 5, for the reason which will be subsequently discussed with particular reference to FIGS. 5 and 6, the slender bridge 18 connecting the take-up and supply casings 12 and 14 together at a location opposite to the front end plate 16 is so shaped and so configured as to have an upper bridge portion 18*a* having one end rigid or integral with a rear end wall portion of the take-up casing 12 adjacent a rear end of the slot 12*a*, a lower bridge portion 18*b* having one end rigid or integral with a rear end wall portion of the supply casing 14 adjacent a rear end of the slot 14*a*, and an intermediate slant bridge portion 18*c* connecting the upper and lower bridge portions 18*a* and 18*b* together and extending slantwise relative to the plane containing the respective longitudinal axes of the take-up and supply casings 12 and 14. The upper and lower bridge portions 18*a* and 18*b* of the slender bridge 18 preferably extends substantially parallel to each other and also to that plane containing the respective longitudinal axes of the casings 12 and 14.

With the slender ridge 18 so shaped and so configured as described above, and since the take-up slot 12*a* in the take-up casing 12 is located at a level generally aligned with the plane containing the respective longitudinal axes of the take-up and supply casings 12 and 14, and the supply slot 14*a* in the supply casing 14 is located a distance below that plane, two relatively large access spaces are formed at S1 and S2, leading to the oblong space 24 in a direction along the direction of insertion In. Specifically, as best shown in FIG. 4, the access space S1 is substantially bound by the upper and slant bridge portions 18*a* and 18*b* in cooperation with a rear end wall of the take-up casing 12 whereas the access space S2 is substantially bound by the slant and lower bridge portions 18*b* and 18*c* in cooperation with a rear end wall of the supply casing 14, said access spaces S1 and S2 being offset relative to each other with respect to the slant bridge portion 18*c*.

Figure 5:
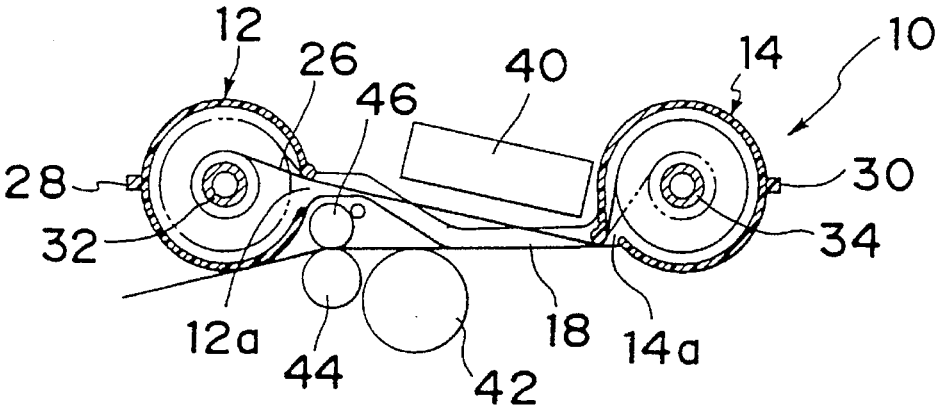
FIG. 5 is a view similar to FIG. 4, showing the positioning of printer elements, particularly a thermal print head, a platen and a pinch roller pair, relative to the ribbon cassette with the thermal print head held at an inoperative position.
Figure 6:
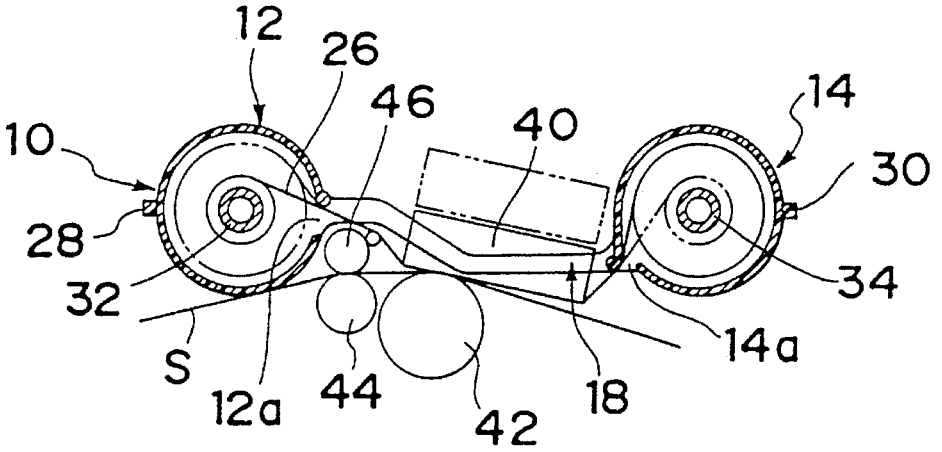
FIG. 6 is a view similar to FIG. 5, but showing the thermal print head moved to a print position.

Referring now to FIG. 5, the video printer comprises a thermal print head 40 disposed at a printing station and supported in any known manner for movement between a print position, shown by the solid line in FIG. 6, and a retracted position, shown by the phantom line in FIG. 6, in a direction generally perpendicular to that portion of the length of inked ribbon 26 extending between the supply slot 14*a* of the supply casing 14 and the take-up slot 12*a* of the take-up casing 12. The video printer also comprises a rotatably supported platen 42 disposed at the printing station and cooperable with the thermal print head 40, when the latter is moved to the print position, to back up a generally oblong image recording sheet S being then fed through the printing station between the thermal print head 40 and the platen 42 in a direction counter to the direction of feed of the length of inked ribbon 26. To feed the image recording sheet S past the printing station, pinch and capstan rollers 44 and 46 are disposed adjacent to and on one side of the platen 42 close to a source of the image recording sheet S as will be described later.

Let it be assumed that the thermal print head 40, the platen 42 and the pinch and capstan rollers 44 and 46 occupy respective predetermined positions inside the video printer as shown in FIGS. 5 and 6. Although not shown in FIGS. 1 to 6, the video printer is provided with guideways for slidably receiving the guide wings 28 and 30 of the ribbon cassette 10, respectively, so that as the ribbon cassette 10 is inserted into the video printer along the direction of insertion In (FIG. 3) with the guide wings 28 and 30 sliding in and along the guideways, at least one of the pinch and capstan rollers, that is, the pinch roller 46, and the thermal print head 40 then held at the retracted position can pass through the access spaces S1 and S2, respectively, substantially as shown in FIG. 6.

Figure 14:
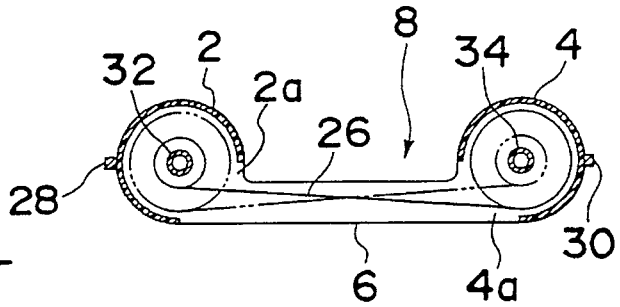
Fig.14 PRIOR ART
FIG. 14 is a sectional view of the prior art ribbon cassette.
Figure 15:
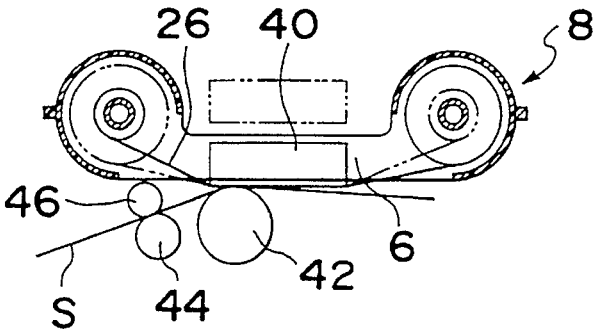
Fig.15 PRIOR ART
FIG. 15 is a sectional view of the prior art ribbon cassette showing the positioning of the printer elements relative to the ribbon cassette.

In other words, the presence of the access spaces S1 and S2 created by the use of the slender bridge 18 makes it possible to reduce the thickness of the video printer as compared with that of the video printer operable with the prior art ribbon cassette shown in FIGS. 14 and 15. This is clearly demonstrated by comparison of FIG. 6 with FIG. 15.

Specifically, with the prior art ribbon cassette 8 in which the respective rear ends of the take-up and supply casings 2 and 4 are connected together by means of the straight slender bridge 6 extending a distance downwardly off from the plane containing the respective longitudinal axes of the casings 2 and 4 as shown in FIGS. 14 and 15, the platen 42 and the roller pair including the pinch and capstan rollers 44 and 46 must be disposed a substantial distance below the plane along which the slender bridge 6 moves during insertion or removal of the prior art ribbon cassette 8 into or from the video printer. Thus, in order for the prior art ribbon cassette 8 to be smoothly inserted into the video printer without being obstructed by the particular printer component parts, the platen 42 and the pinch and capstan roller pair must be positioned clear from the path of movement of the slender bridge 6 during the insertion or removal of the ribbon cassette into or from the video printer, rendering the video printer itself to have a substantial thickness.

In contrast thereto, as comparison of FIG. 6 with FIG. 15 makes it clear, the access spaces S1 and S2 accommodate both of the pinch and capstan roller pair and the platen 42 and the thermal print head 40, respectively, during the insertion or removal of the ribbon cassette 10 of the present invention into or from the video printer, and therefore, the video printer itself may have a reduced thickness.

To describe the operation of the video printer so far shown in FIGS. 5 and 6, the oblong image recording sheet S having first and second ends opposite to each other is initially fed from the left to the right as viewed in FIG. 6 past the printing station with the first end oriented towards the right and is then temporarily held in position with the first end sandwiched between the pinch and capstan rollers 44 and 46. A predetermined time after this condition has been established, the image recording sheet S temporarily held at the right is fed backwards by the pinch and capstan rollers 44 and 46 from the right towards the left. Simultaneously with the backward movement of the recording sheet S, the thermal print head 40 then held at the retracted position shown by the solid line in FIG. 5 and the phantom line in FIG. 6 is moved to the print position with that portion of the length of inked ribbon 26 between the slots 14*a* and 12*a* consequently sandwiched between the thermal print head 40 and the platen 42 together with the recording sheet S as shown in FIG. 6. Image printing takes place as that portion of the length of inked ribbon 26 and the recording sheet S are simultaneously fed towards the left and, during this movement, that portion of the length of inked ribbon 26 is taken up around the take-up spool 32 within the casing 12 and the recording sheet S is fed so as to diverge from that portion of the length of inked ribbon 26. By so doing, one cycle of printing completes. Where the image to be printed is in monochrome, the single cycle of printing is sufficient, but where the image is desired to be printed in full color, the cycle of printing is repeated three times. In any event, the details of the operation will become clear from the subsequent description which will be made with reference to FIGS. 11 to 13.

From the foregoing description, it is clear that the unique design of the slender bridge 18 contributes to reduction in thickness of the video printer and, hence, it is clear that the video printer itself can advantageously be assembled compact in size and appealing in appearance.

In the foregoing embodiment, the slender bridge 18 connecting together the rear ends of the respective casings 12 and 14 of the ribbon cassette 10 has been shown and described as configured so as to bend at two locations along the length thereof to thereby have the first and second bridge portions 18*a* and 18*b* and the intermediate bridge portion 18*c*. However, as shown by 18' in FIGS. 7 and 8, the slender bridge employed in the ribbon cassette now identified by 10' may be straight and extends slantwise between the casings 12 and 14, having its opposite end rigid or integral with the rear end walls of the casings 12 and 14. The ribbon cassette 10' shown in FIGS. 7 and 8 is substantially identical with the ribbon cassette 10 shown in FIGS. 1 to 6, except for the shape of the slender bridge.

Figure 7:
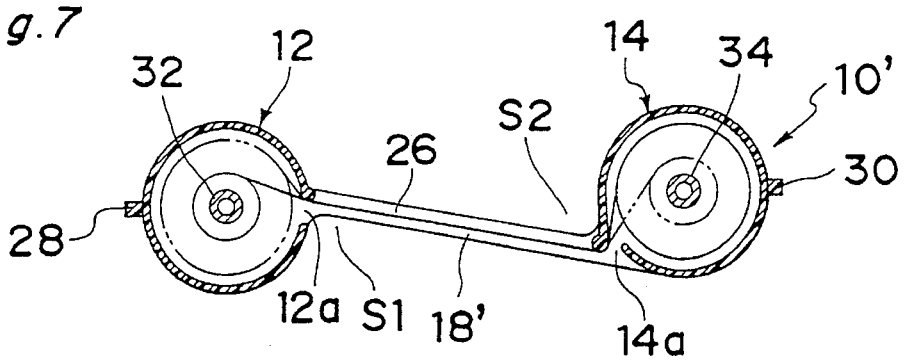
FIG. 7 is a view similar to FIG. 4, showing the ribbon cassette according to a second preferred embodiment of the present invention.
Figure 8:
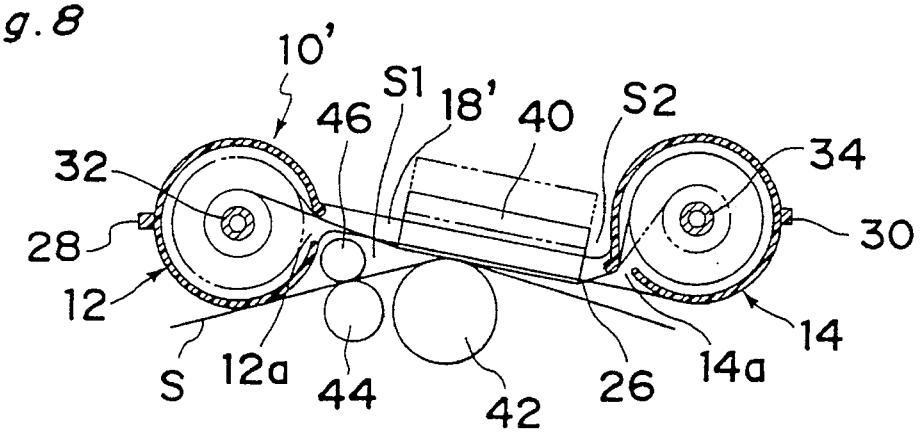
FIG. 8 is a view similar to FIG. 6, showing the ribbon cassette according to the second preferred embodiment of the present invention.

According to the second embodiment shown in FIGS. 7 and 8, even though the slender bridge 18' is straight, the relatively large access spaces S1 and S2 can be secured as is the case with the foregoing embodiment shown particularly in FIGS. 2 and 4 to 6. This is clearly evidenced by the comparison of FIG. 8 with FIG. 15 and, hence, the insertion or removal of the ribbon cassette 10' according to the embodiment shown in FIGS. 7 and 8 into or from the video printer can easily and smoothly be accomplished without being obstructed by the pinch and capstan roller pair and the platen 42 in a manner similar to that described in connection with the ribbon cassette 10 of the foregoing embodiment.

Figure 9:
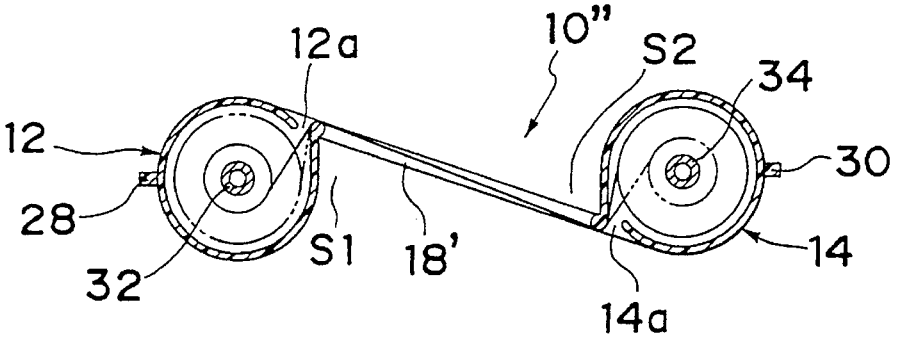
FIGS. 9 and 10 are views similar to FIGS. 7 and 8, respectively, showing a modified form of the ribbon cassette shown in FIGS. 7 and 8.
Figure 10:
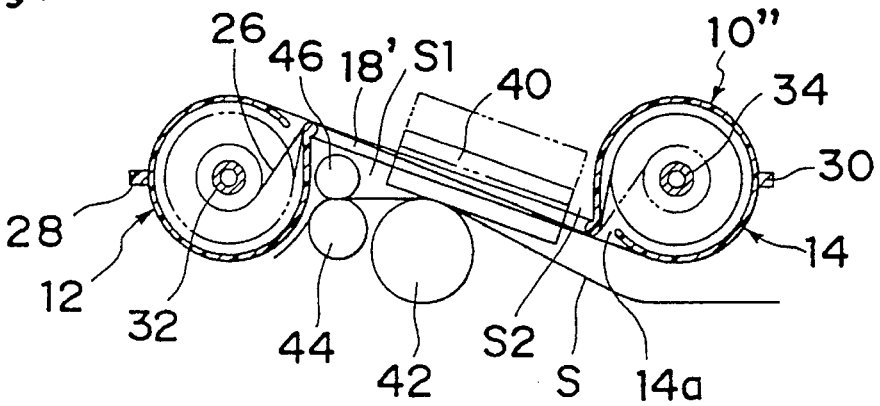

FIGS. 9 and 10, which are similar in view to FIGS. 7 and 8, respectively, illustrate a modified form of the ribbon cassette 10' In this modified ribbon cassette shown by 10" in FIGS. 9 and 10, the take-up slot 12*a* in the take-up casing 12 is located a distance above the plane containing the respective longitudinal axes of the take-up and supply casings 12 and 14 so as to open diagonally upwardly on one side of the take-up casing 12 adjacent the supply casing 14, while the supply slot 14*a* in the supply casing 14 remains substantially the same as that in any one of the foregoing embodiments, that is, located a distance below that plane so as to opens diagonally downwardly on one side of the supply casing 14 adjacent the take-up casing 12. Even in this modification, that portion of the length of inked ribbon 26 emerging downwardly outwardly through the supply slot 14*a* can travel towards the take-up slot 12*a* in the take-up casing 12 along a generally upwardly oriented path.

Figure 3:
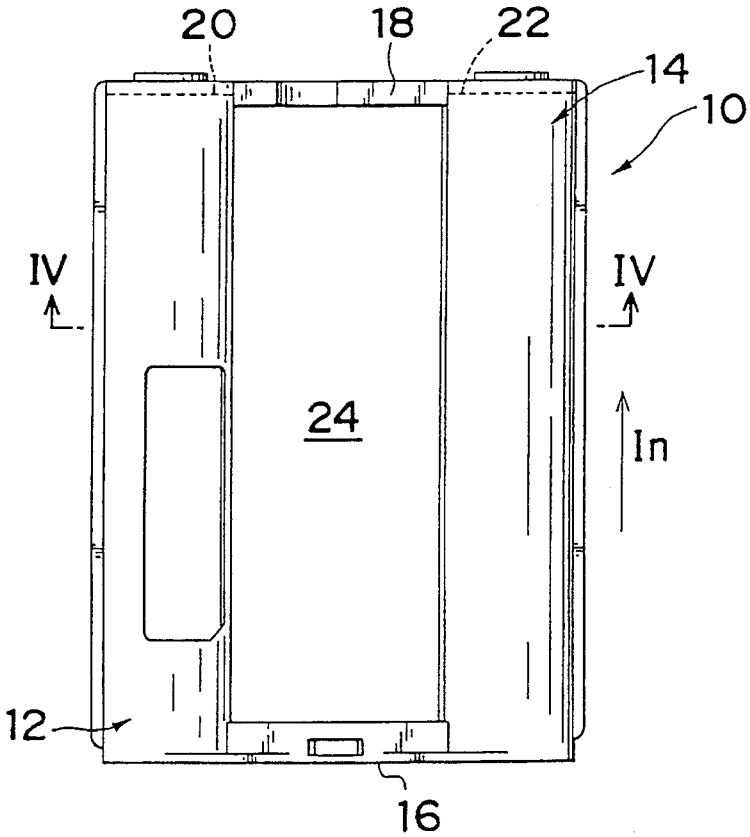
FIG. 3 is a top plan view of the ribbon cassette shown in FIG. 1.

According to the modification shown in FIGS. 9 and 10, the cross-sectional representation of the modified ribbon cassette 10" taken substantially along the line IV—IV shown in FIG. 3 is substantially symmetrical with respect to a point of intersection between the straight slender bridge 18" and the plane containing the respective longitudinal axes of the cylindrical casings 12 and 14. Therefore, the access spaces S1 and S2 offset in position relative to each other are substantially similar in size to each other and are effective to accomplish a maximized efficiency of utilization of space as compared with those in any one of the foregoing embodiments.

The video printer operable with the ribbon cassette designed according to any one of the foregoing embodiments, for example, the embodiment shown in FIGS. 1 to 6, will now be described with particular reference to FIGS. 11 to 13. As shown therein, in addition to the thermal print head 40, the platen 42, the pinch roller 44 and the capstan roller 46, the video printer also includes a sheet supply unit generally identified by 50, a first sheet guide mechanism interposed between the sheet supply unit 50 and the pinch and capstan roller pair and a second sheet guide mechanism positioned on one side of the ribbon cassette 10 opposite to the sheet supply unit 50.

The sheet supply unit 50 comprises a sheet cassette 51 accommodating a stack of recording sheets S and adapted to be slidably inserted into a sheet supply chamber, defined in the video printer, along cassette guides, only one of which is shown by 52; a lift tray 53 accommodated within the sheet cassette 51 for the support of the stack of the recording sheets S thereon and movable up and down to lift or lower the stack of the recording sheets S therethrough; a pivotally supported lift lever 54 for moving the lift tray 53 up and down and normally biased to move the lift tray 53 upwardly so as to allow the uppermost recording sheet S to be held in contact with a pick-up roller 55; and a feed roller pair including a separator roller 56 and a reverse roller 57 capable of being pressed against the separator roller 56 for feeding the uppermost recording sheet S, drawn by the pickup roller 55 outwardly from the sheet cassette 51, onto a guide plate 58 interposed between the feed roller pair and the pinch and capstan roller pair. It is to be noted that the guide plate 58 constitutes the first sheet guide mechanism referred to above and has one end adjacent the pinch and capstan roller pair provided with a sheet check sensor 59 for detecting, and generating an electric signal indicative of, passage of a trailing end of the recording sheet S towards the second sheet guide mechanism.

The second sheet guide mechanism referred to above is of a known construction and includes first and second curved guide members 60 and 61 spaced from each other a distance corresponding to the thickness of the recording sheet S so as to define a generally L-shaped guide path that extends substantially along the bottom of the video printer and then upwardly along one of the side walls of the video printer, and a generally transversely extending guide support block 63 having a guideway 63*a* and a guide face 63*b* both defined therein. The guideway 63*a* of the guide support block 63 serves to slidably receive and guide the corresponding guide wing 30 of the ribbon cassette 10 as the latter is inserted into or removed from the video printer, and the guide face 63*b* serves as an extension of the L-shaped guide path as shown. It is to be noted that the first guide member 60 may be a part of the side wall of the video printer.

The video printer further comprises a second guide support block 64 having defined therein a guideway 64*a* for slidably receiving and guiding the guide win 28 of the ribbon cassette 10 during insertion or removal of the latter into or from the video printer and a guide face 64*b*. The guide face 64*b* cooperates in part with the guide plate 58 to define a guide path leading to a nipping region between the pinch and capstan rollers 44 and 46 and in part with a generally elongated deflector 65 to define a guide path leading from the nipping region between the pinch and capstan rollers 44 and 46 towards a sheet discharge tray 66 through a discharge roller pair including an idle discharge roller 67 and a motor-coupled drive roller 68.

The elongated deflector 65 has one end adjacent the guide plate 58 provided with a pivotally coupled selector pawl 65*a* for movable between first and second positions. This selector pawl 65*a* when in the first position as shown in FIG. 11 communicates the guide path, defined adjacent the pinch and capstan roller pair and between the first part of the guide face 64*b* and the guide plate 58, with the guide path defined between the second part of the guide face 64*b* and the deflector 65 and leading to the sheet discharge tray 66, but when in the second position it allows the recording sheet S, fed from the sheet supply unit 50, to be fed towards the printing station.

Reference numeral 69 represents a cooling fan assembly for forcibly cooling the thermal print head 40 by introducing air from the outside of the video printer. Reference numeral 40*a* represents an IC protective cover fitted to the thermal print head 40 for protecting an IC circuit component of the thermal print head 40 and also for guiding that portion of the length of inked sheet 26 and the recording sheet S to avoid any possible contact thereof with a non-working portion of the thermal print head 40.

The video printer of the above described construction operates in the following manner.

The sheet cassette 51 and the ribbon cassette 10 have to be loaded in the video printer. Loading of the sheet cassette 51 can be accomplished in any known manner by inserting the sheet cassette 51 onto the supply unit 50 along the cassette guides 52. On the other hand, loading of the ribbon cassette 10 is carried out by pushing the ribbon cassette 10 into the video printer with the guide wings 28 and 30 thereof slidingly received within and guided along the guideways 64*a* and 63*a* in the guide support blocks 64 and 63, respectively. As shown therein, the ribbon cassette 10 is supported inside the video printer in an inclined fashion with the guide wing 28 held at a level higher than the guide wing 30. At this time, the thermal print head 40 is held at the retracted position shown by the phantom line in FIG. 11 and that portion of the length of inked ribbon 26 extending between the slots 14*a* and 12*a* extends straight above the platen 42. However, as hereinbefore discussed in connection with the particulars of the ribbon cassette 10 with reference to FIGS. 1 to 6, even though the ribbon cassette 10 is supported in the inclined fashion, that portion of the length of inked ribbon 26 extend diagonally upwardly from the supply slot 14*a* of the supply casing 14 towards the take-up slot 14*b* of the take-up casing 12 and between the thermal print head 40 then in the retracted position and the platen 42.

In a manner known to those skilled in the art, upon complete insertion of the ribbon cassette 10 into the video printer, at least the take-up spool 32 within the take-up casing 12 of the ribbon cassette is drivingly coupled with a drive element (not shown) so that the length of inked ribbon 26 can be intermittently wound from the supply spool 34 towards the take-up spool 32 on a frame-to-frame basis.

When the user of the video printer actuates a "PRINT" button in an attempt to make a print of, for example, a televised picture, the uppermost one of the recording sheets S in the sheet supply unit 50 is drawn and delivered by the pick-up roller 55 outwardly therefrom onto the nipping region between the rollers 56 and 57. The reverse roller 57 held at a disengaged position is then driven clockwise, as viewed in FIG. 11, and subsequently brought to an engaged position to feed the recording sheet S past through the nipping region between the rollers 56 and 57 and onto the guide plate 58 in cooperation with the separator roller 56.

Figure 11:
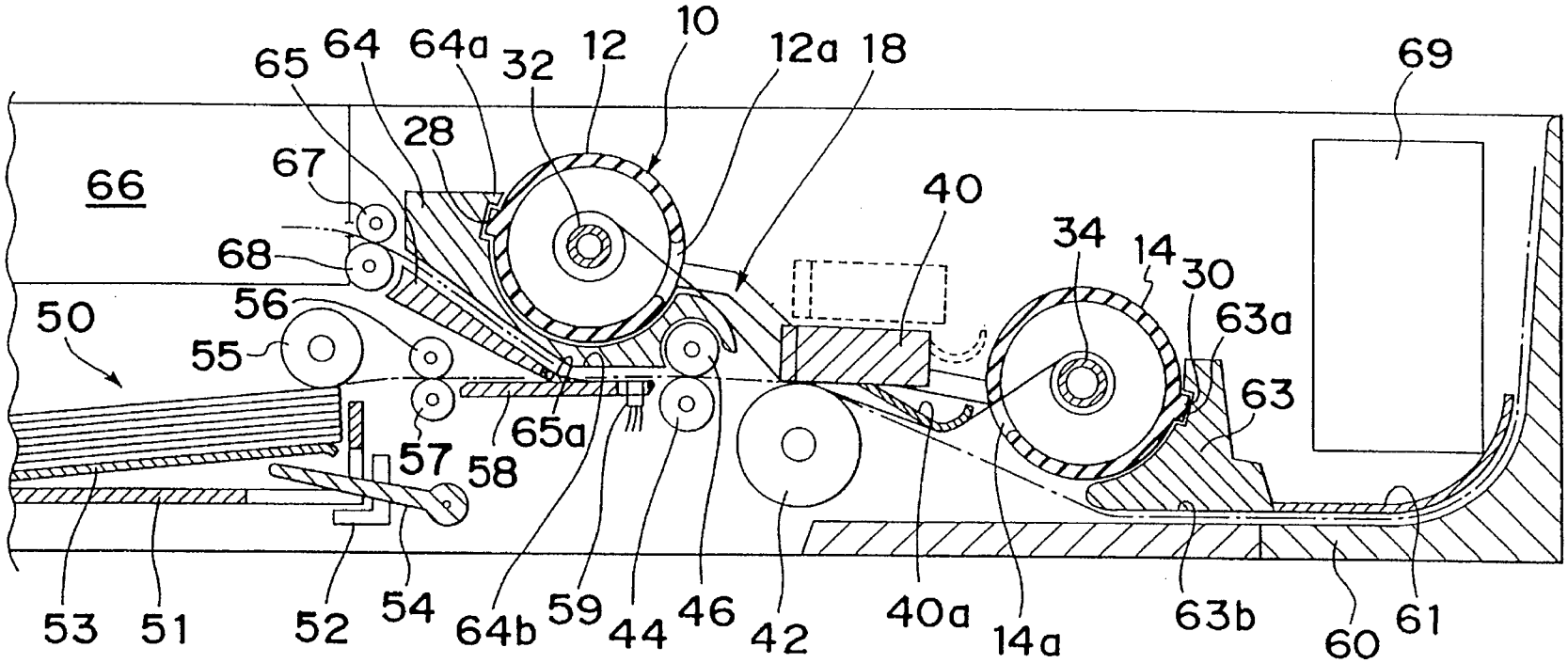
FIG. 11 is a schematic sectional view of a video printer utilizing the ribbon cassette according to the present invention.

The recording sheet S being delivered onto the guide plate 58 has its leading end sandwiched between the pinch roller 44 and the capstan roller 46, then driven clockwise as viewed in FIG. 11, and then oriented towards the guide path between the guide members 60 and 61 past the printing station. As soon as the trailing end of the recording sheet S mover over the sheet end sensor 59, the reverse roller 57 having been engaged with the separator roller 56 is disengaged therefrom to interrupt the feed of the recording sheet S and, hence, the recording sheet S is held still with its leading end positioned inside the L-shaped guide path between the guide members 60 and 61 and with its trailing end sandwiched between the pinch and capstan rollers 44 and 46.

While the recording sheet S is held still in the manner described above, the thermal print head 40 is moved to the print position as shown by the solid line and, substantially simultaneously with application of a video signal to the thermal print head 40, not only the length of inked ribbon 26 is wound onto the take-up spool 32 a distance corresponding to a frame size, but the capstan roller 46 is driven counterclockwise to feed the recording sheet S backwards in cooperation with the pinch roller 44. As is well known to those skilled in the art, the backward movement of the recording sheet S driven by the pinch and capstan roller pair is synchronized with that of that portion of the length of inked ribbon 26 between the slots 14*a* and 12*a* so that the thermally fusible pigment on that portion of the length of inked ribbon 26 can be transferred onto the recording sheet in a pattern required to provide an image corresponding to the televised picture.

The recording sheet S being moved backwards subsequently enters the guide path between the first part of the guide face 64*b* and the guide plate 58 and subsequently guided by the selector pawl 65*a*, then moved from the second position to the first position, into the guide path between the second part of the guide face 64*b* and the deflector 65 until the recording sheet S is discharged onto the sheet discharge tray 66 by way of the nipping region between the rollers 67 and 68, thereby completing one cycle of printing.

In the case of the full color printing, the single recording sheet S is passed three times across the printing station without being completely discharged onto the sheet discharge tray 66, so that cyan, magenta and yellow pigments can be deposited on the single recording sheet as is well known to those skilled in the art.

While the video printer is so constructed as hereinbefore described, it has been found that the second guide sheet mechanism comprised of the guide members 60 and 61 has a problem. While the feed of the recording sheet S into the guide path between the guide members 60 and 61 would pose no problem, a problem tends to occur during the backward feed of the recording sheet. Specifically, during the backward feed of the recording sheet S, the recording sheet S is sandwiched between the thermal print head 40, then in the print position, and the platen 42 and is therefore loaded considerably.

At the same time, friction takes place between the recording sheet S being moved backwards and any one of the guide members 60 and 61. If the composite force, that is, the sum of the force acting on the recording sheet S at the printing station and the frictional force acting in the guide path between the guide members 60 and 61, exceeds the force necessary to drag the recording sheet S backwards, not only may a color displacement occur, but also a print surface of the recording sheet S may be scratched in sliding contact with the curved guide member 61.

If the force necessary to drag the recording sheet S backwards is increased which may be accomplished by increasing a clamp force acting from the pinch roller 44 against the capstan roller 46, a drive motor for driving the capstan roller 46 must be of a type having an increased torque, which eventually results in increase in cost and also in size of the video printer.

Figure 12:
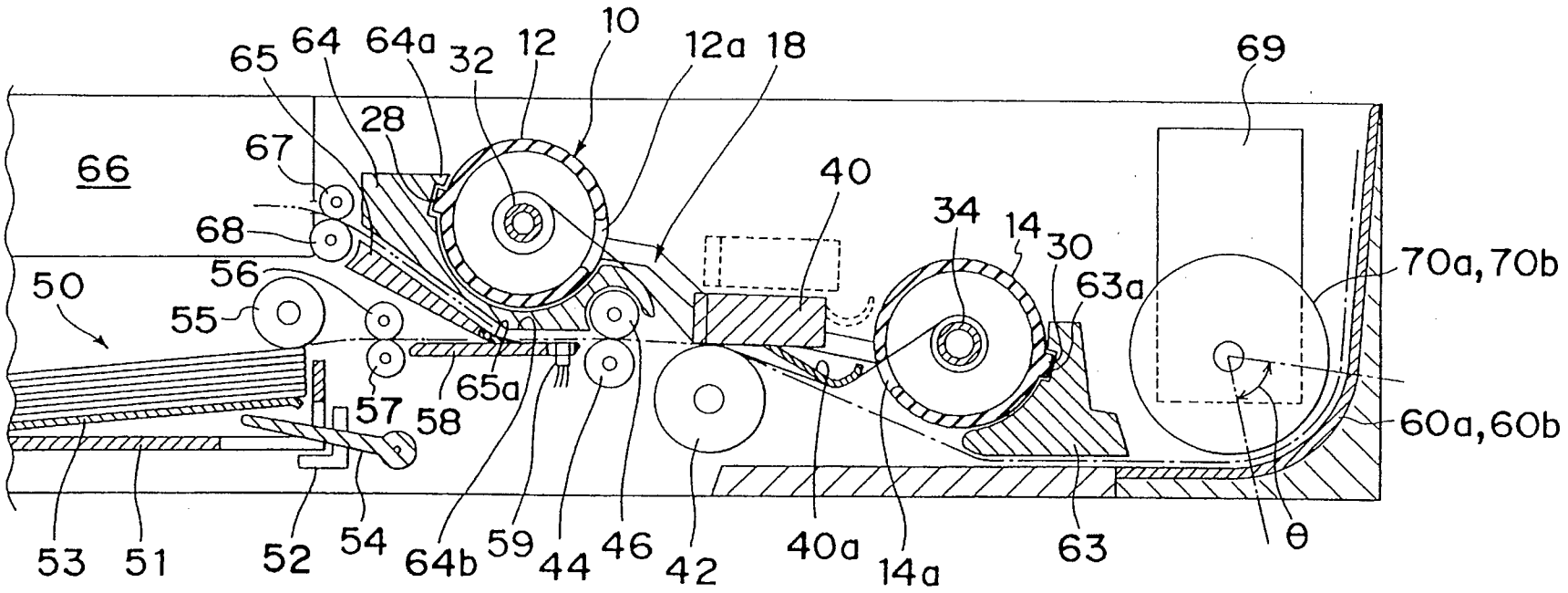
FIG. 12 is a view similar to FIG. 11, showing a third preferred embodiment of the present invention.
Figure 13:
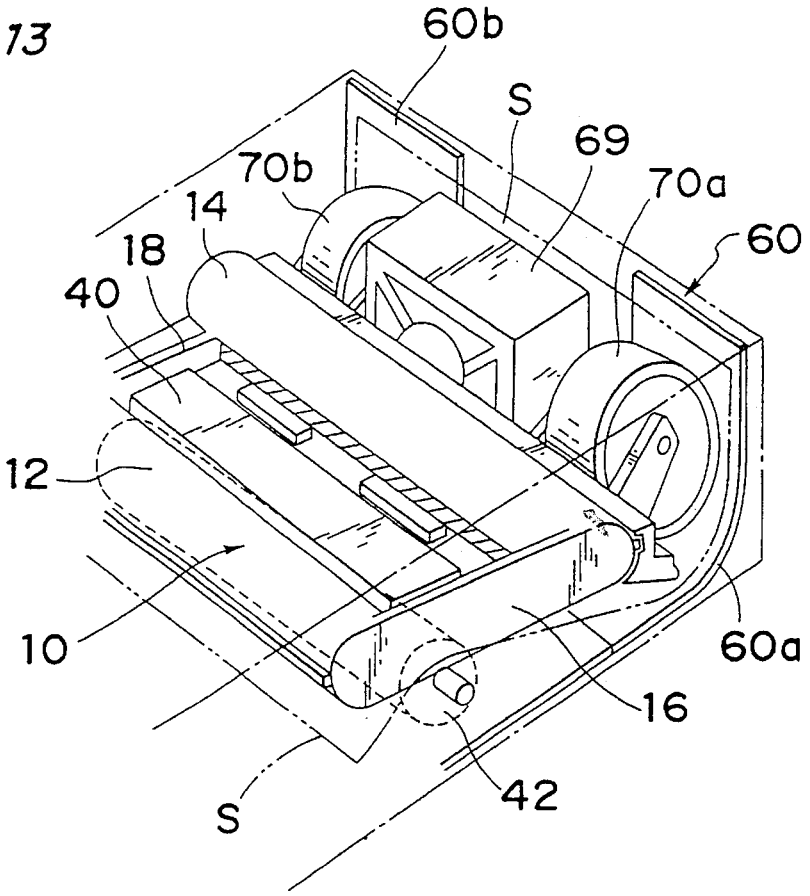
FIG. 13 is a fragmentary perspective view of a portion of the ink printer according to the third preferred embodiment of the present invention.

In order to alleviate the above discussed problem, such an embodiment as shown in FIGS. 12 and 13 is provided in which is employed an improved second sheet guide mechanism. Referring to FIGS. 12 and 13, one of the guide members, that is, the guide member 60, is comprised of two generally L-shaped guide stripe 60*a* and 60*b* spaced from each other a distance sufficient to accommodate the width of the recording sheet S.

Each curved guide stripe 60*a* and 60*b* is so shaped and so curved as to extend along the bottom of the video printer and then along the upright side wall of the video printer, having been curved at a predetermined curvature. A freely rotatably supported guide roller 70*a* and 70*b* is provided for each L-shaped guide stripe 60*a* and 60*b* and is so positioned relative to the associated L-shaped guide stripe 60*a* and 60*b* that the curvature of an outer peripheral surface of the respective guide roller 70*a* and 70*b* follows the curvature of the associated L-shaped guide stripe 60*a* and 60*b*.

Hence, the center of the circle occupied by the outer peripheral surface of each guide roller 70*a* and 70*b*, that is, the axis of rotation of each guide roller 70*a* and 70*b*, coincides with the center of curvature of the associated L-shaped guide stripe 60*a* and 60*b*, but the outer peripheral surface of the respective guide roller 70*a* and 70*b* is spaced from the associated guide stripe 60*a* and 60*b* a distance sufficient to accommodate the maximum possible thickness of the recording sheet S therebetween.

As best shown in FIG. 13, the guide rollers 70*a* and 70*b* are positioned on respective sides of the cooling fan assembly 69 used to forcibly cool the thermal print head 40 to minimize the overall dimension of the video printer though, instead of the use of the two separate guide rollers 70*a* and. 70*b*, a single roller of a generally cylindrical shape may be employed in the practice of the present invention.

Where the video printer employs the second guide mechanism including the guide rollers 70*a* and 70*b* as shown in FIGS. 12 and 13, it is clear that movement of the recording sheet S within the guide path defined between the outer peripheral surfaces of the respective guide rollers 70 and 70*b* and the associated curved guide stripes 60*a* and 60*b* takes place smoothly with no substantial friction occurring therebetween, thereby minimizing the possibility of the recording sheet S being frictionally scratched and also that of occurrence of the color displacement. Also, the force necessary to draw the recording sheet during the backward movement thereof is also advantageously reduced. It is to be noted that the greater the angle of turn 8 over which the recording sheet S may contact the guide rollers 70*a* and 70*b*, the lower the load on the guide rollers 70*a* and 70*b* and the lower the possibility of the recording sheet S being scratched.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A ribbon cassette for accommodating a length of inked ribbon for use with a thermal wax transfer printer, which cassette comprises:

a generally cylindrical supply casing having a first longitudinal axis and also having a supply slot defined therein so as to extend parallel to the first longitudinal axis thereof;

a supply spool rotatably accommodated within the supply casing;

a generally cylindrical take-up casing having a second longitudinal axis parallel to the first longitudinal axis and also having a take-up slot defined therein so as to extend parallel to the second longitudinal axis thereof and also to said supply slot;

a take-up spool rotatably accommodated within the take-up casing;

a length of inked ribbon having opposite ends engaged with the supply and take-up spools within the supply and take-up casings, respectively, a major portion of said length of inked ribbon when the ribbon cassette is not in use being wound around the supply spool;

a front end plate having opposite end portions thereof secured to and closing respective front open ends of the supply and take-up casings; and a slender bridge having opposite ends secured to respective rear ends of the supply and take-up casings and extending therebetween;

said take-up slot being located at a level generally aligned with a plane, containing the first and second longitudinal axes, and opening laterally outwardly so as to confront the supply casing, said supply and take-up slots being so positioned relative to each other as to permit a portion of the length of inked ribbon extending between the supply and take-up slots to extend diagonally upwardly from the supply slot towards the take-up slot.

2. The ribbon cassette as claimed in claim 1, wherein each of said supply and take-up slots is delimited by opposite lip regions of the wall of the respective casing, and wherein one of the opposite lip regions of the wall of at least the supply casing, which faces a coated surface of the length of inked ribbon, is positioned radially inwardly of the other of the longitudinal lip regions thereof.

3. The ribbon cassette as claimed in claim 2, wherein said one of the opposite lip regions of the wall of the supply casing is positioned at a level higher than a level at which a recording sheet may pass, to thereby avoid any possible plunging of the recording sheet into the supply slot.

4. The ribbon cassette as claimed in claim 1, wherein said slender bridge extends straight between the respective rear ends of the supply and take-up casings and slantwise relative to the plane containing the first and second longitudinal axes.

5. A video printer operable with a ribbon cassette for accommodating a length of inked ribbon for use with a thermal wax transfer printer, said cassette comprising a generally cylindrical supply casing having a supply slot defined therein so as to extend parallel to a first longitudinal axis of said supply casing, said supply casing rotatably accommodating therein a supply spool; a generally cylindrical take-up casing having a take-up slot defined therein so as to extend parallel to a second longitudinal axis of said take-up casing and also to the supply slot, said take-up casing rotatably accommodating therein a take-up spool; a length of inked ribbon having opposite ends engaged with the supply and take-up spools within the supply and take-up casings, respectively, with a major portion thereof wound around the supply spool when the cassette is not in use; a front end plate having opposite end portions thereof secured to and closing respective front open ends of the supply and take-up casings; and a slender bridge having opposite ends secured to respective rear ends of the supply and take-up casings and extending therebetween, said slender bridge comprising first and second straight bridge portions and an intermediate slant bridge portion, said first straight bridge portion having one end rigid with the rear end of the take-up casing adjacent a rear end of the take-up slot, said second straight bridge portion having one end rigid with the rear end of the supply casing adjacent a rear end of the supply slot, and said intermediate slant bridge portion connecting said first and second straight bridge portions together and extending slantwise relative to the place containing the first and second longitudinal axes, and wherein said take-up slot is located at a level generally aligned with a plane, containing the first and second longitudinal axes, and opening laterally outwardly so as to confront the supply casing and said supply and take-up slots is so positioned relative to each other as to permit a portion of the length of inked ribbon extending between the supply and take-up slots to extend diagonally upwardly from the supply slot towards the take-up slot, said printer comprising:

a sheet supply unit adapted to accommodate a stack of recording sheets;

a thermal print head supported for movement between print and retracted positions at a printing station;

a platen disposed at the printing station and cooperable with the thermal print head, when the latter is moved to the print position, to allow an ink material to be transferred from the length of inked ribbon onto one of the recording sheets then fed to the printing station;

a first guide mechanism extending between the sheet supply unit and the printing station;

a second guide mechanism extending from the printing station to a temporary storage position defined on one side of the printing station remote from the first guide mechanism; and pinch and capstan rollers disposed generally between the printing station and the first guide mechanism for feeding one of the recording sheet, which has been guided by the first guide mechanism, towards the printing station in a generally synchronized fashion with movement of the thermal head towards the print position, said pinch roller being, when the ink cassette is accommodated in the video printer, accommodated in a first space adjacent the take-up casing and below the slender bridge while said thermal print head is disposed in a second space adjacent the supply casing and above the slender bridge.

6. A video printer operable with a ribbon cassette for accommodating a length of inked ribbon for use with a thermal wax transfer printer, said cassette comprising a generally cylindrical supply casing having a supply slot defined therein so as to extend parallel to a first longitudinal of said supply casing, said supply casing rotatably accommodating therein a supply spool; a generally cylindrical take-up casing having a take-up slot defined therein so as to extend parallel to a second longitudinal axis of said take-up casing and also to the supply slot, said take-up casing rotatably accommodating therein a take-up spool; a length of inked ribbon having opposite ends engaged with the supply and take-up spools within the supply and take-up casings, respectively, with a major portion thereof wound around the supply spool when the cassette is not in use; a front end plate having opposite end portions thereof secured to and closing respective front open ends of the supply and take-up casings; and a slender bridge having opposite ends secured to respective rear ends of the supply and take-up casings and extending therebetween, and wherein said take-up slot is located at a level generally aligned with a plane, containing the first and second longitudinal axes, and opening laterally outwardly so as to confront the supply casing and said supply and take-up slots is so positioned relative to each other as to permit a portion of the length of inked ribbon extending between the supply and take-up slots to extend diagonally upwardly from the supply slot towards the take-up slot, said printer comprising:

a sheet supply unit adapted to accommodate a stack of recording sheets;

a thermal print head supported for movement between print and retracted positions at a printing station;

a platen disposed at the printing station and cooperable with the thermal print head, when the latter is moved to the print position, to allow an ink material to be transferred from the length of inked ribbon onto one of the recording sheets then fed to the printing station;

a first guide mechanism extending between the sheet supply unit and the printing station;

a second guide mechanism extending from the printing station to a temporary storage position defined on one side of the printing station remote from the first guide mechanism; and pinch and capstal rollers disposed generally between the printing station and the first guide mechanism for feeding one of the recording sheet, which has been guided by the first guide mechanism, towards the printing station in a generally synchronized fashion with movement of the thermal head towards the print position, said pinch roller being, when the ink cassette is accommodated in the video printer, accommodated in a first space adjacent the take-up casing and below the slender bridge while said thermal print head is disposed in a second space adjacent the supply casing and above the slender bridge.

7. The video printer as claimed in claim 6, wherein said first space is of a generally triangular shape delimited by the take-up casing and one end portion of the slender bridge adjacent the take-up casing, and said second space is of a generally triangular shape delimited by the supply casing and the opposite end portion of the slender bridge adjacent the supply casing.

8. The video printer as claimed in claim 6, wherein said second guide mechanism comprises first and second, generally L-shaped guide stripes spaced from each other a distance sufficient to accommodate a width of the recording sheet, each of said first and second guide stripes being so curved at a predetermined curvature as to permit the recording sheet to extend along a generally L-shaped path, and at least one rotatably supported roller disposed adjacent the first and second guide stripes, respectively, to define the L-shaped path therebetween, said guide roller having an outer peripheral surface of a curvature following the curvature of the guide stripes.

9. A ribbon cassette for accommodating a length of inked ribbon for use with a thermal wax transfer printer, which cassette comprises:

a generally cylindrical supply casing having a first longitudinal axis and also having a supply slot defined therein so as to extend parallel to the first longitudinal axis thereof;

a supply spool rotatably accommodated within the supply casing;

a generally cylindrical take-up casing having a second longitudinal axis parallel to the first longitudinal axis and also having a take-up slot defined therein so as to extend parallel to the second longitudinal axis thereof and also to said supply slot;

a take-up spool rotatably accommodated within the take-up casing;

a length of inked ribbon having opposite ends engaged with the supply and take-up spools within the supply and take-up casings, respectively, a major portion of said length of inked ribbon when the ribbon cassette is not in use being wound around the supply spool;

a front end plate having opposite end portions thereof secured to and closing respective front open ends of the supply and take-up casings; and a slender bridge having opposite ends secured to respective rear ends of the supply and take-up casings and extending therebetween;

said slender bridge comprising first and second straight bridge portions and an intermediate slant bridge portion, said first straight bridge portion having one end rigid with the rear end of the take-up casing adjacent a rear end of the take-up slot, said second straight bridge portion having one end rigid with the rear end of the supply casing adjacent a rear end of the supply slot, and said intermediate slant bridge portion connecting said first and second straight bridge portions together and extending slantwise relative to the plane containing the first and second longitudinal axes, and said take-up slot being located at a level generally aligned with a pane, containing the first and second longitudinal axes, and opening laterally outwardly so as to confront the supply casing, said supply and take-up slots being so positioned relative to each other as to permit a portion of the length of inked ribbon extending between the supply and take-up slots to extend diagonally upwardly from the supply slot towards the take-up slot.

10. The ribbon cassette as claimed in claim 9, wherein each of said supply and take-up slots is delimited by opposite lip regions of the wall of the respective casing, and wherein one of the opposite lip regions of the wall of at least the supply casing, which faces a coated surface of the length of inked ribbon, is positioned radially inwardly of the other of the longitudinal lip regions thereof.

11. The ribbon cassette as claimed in claim 10, wherein said one of the opposite lip regions of the wall of the supply casing is positioned at a level higher than a level at which a recording sheet may pass, to thereby avoid any possible plunging of the recording sheet into the supply slot.

* * * * *

UNITED STATES PATENT AND TRADE MARK OFFICE

CERTIFICATE OF CORRECTION

PATENT NO. : 5,584,587
DATED : December 17, 1996
INVENTOR(S) : Koike et al.

It is certified that error appears in the above-identified patent and that said Letters Patent is hereby corrected as shown below:

Column 16, line 21, the word "pane" should be --plane--.

Signed and Sealed this

Fifth Day of August, 1997

Bruce Lehman

*Attest:*

BRUCE LEHMAN

*Attesting Officer*

*Commissioner of Patents and Trademarks*